US006148953A

United States Patent [19]

Fujitani

[11] Patent Number: 6,148,953

[45] Date of Patent: Nov. 21, 2000

[54] LOUDSPEAKER COMPONENT AND RESIN COMPOSITION THEREFOR

[75] Inventor: Takeshi Fujitani, Osaka, Japan

[73] Assignee: Onkyo Corporation, Neyagawa, Japan

[21] Appl. No.: 09/400,824

[22] Filed: Sep. 21, 1999

[30] Foreign Application Priority Data

Sep. 21, 1998 [JP] Japan ..... 10-266242
Sep. 9, 1999 [JP] Japan ..... 11-255157

[51] Int. Cl.[7] ..... G10K 13/00

[52] U.S. Cl. ..... 181/169; 181/171; 181/199

[58] Field of Search ..... 181/157, 167, 181/169, 171, 199; 307/400

[56] References Cited

U.S. PATENT DOCUMENTS 5,610,455 3/1997 Allen et al. ..... 307/400

*Primary Examiner*—Khanh Dang
*Attorney, Agent, or Firm*—Armstrong, Westerman, Hattori, McLeland & Naughton

[57] ABSTRACT

A loudspeaker component is made of a resin composition containing, as a main constituent, a syndiotactic polyolefin or syndiotactic polystyrene having an Mw/Mn value of no more than 4 or less. The loudspeaker component may be a diaphragm, voice coil bobbin, center cap, frame and/or a cabinet of a loudspeaker.

20 Claims, 3 Drawing Sheets

LOUDSPEAKER COMPONENT AND RESIN COMPOSITION THEREFOR

BACKGROUND OF THE INVENTION

1. Field of the Invention

The present invention relates to a loudspeaker component and a resin composition used for making such a component. More particularly, the present invention relates to improvements of a loudspeaker component with respect to acoustic properties (i.e., internal loss, elasticity and stiffness), dimensional stability against heat and moisture, and weight.

2. Description of the Related Art

Conventionally, paper has been widely used for making a loudspeaker component such as a diaphragm, a voice coil bobbin, a center cap, a frame, a speaker cabinet or the like. This is because the loudspeaker component made of paper has a light weight while being appropriate with respect to internal loss and stiffness. However, the paper loudspeaker component has been found to be insufficient in water- and moisture-resistance. Further, due to the low elasticity of paper, the paper loudspeaker component fails to provide satisfactory acoustic properties. In addition, since the paper loudspeaker component requires a paper-forming step and a complicated shaping step for its fabrication, the production efficiency is relatively low, but yet the product quality tends to vary from product to product.

On the other hand, proposal has been also made to use a metal foil for making a loudspeaker component. Compared with a paper loudspeaker component, the metal foil loudspeaker component provides improvements with respect water-resistance, moisture-resistance and elastic modulus. However, due to the higher weight of a metal foil, a voice coil bobbin made of a metal foil for example is low in operating efficiency and unsatisfactory with respect to transient characteristics. Further, the metal foil loudspeaker component has a low internal loss, resulting in poor acoustic properties.

In order to solve the above-mentioned problems, research has been made for an engineering plastic material such as polyimide (PI) or polyphenylene sulfide (PPS) as a candidate for making a loudspeaker component having a high elasticity and a light weight. However, due to a large thermal expansion coefficient, a loudspeaker component made of such an engineering plastic material may differ greatly in thermal expansion from another component made of a different material. As a result, these components may be deformed (e.g., from a circular shape to an oval shape) at the connection therebetween, or the connection may be broken (e.g., separation of a voice coil from a voice coil bobbin). In this way, a loudspeaker component made of an engineering plastic material is dimensionally unstable under heat.

SUMMARY OF THE INVENTION

It is therefore an object of the present invention to provide a loudspeaker component which is light in weight and has excellent acoustic properties (i.e., with respect to internal loss, elasticity and stiffness) while providing an excellent dimensional stability against heat and moisture.

Another object of the present invention is to provide a resin composition which may be advantageously used for making such a loudspeaker component.

According to a first aspect of the present invention, there is provided a loudspeaker component made of a resin composition comprising, as a main constituent, a syndiotactic polymer selected from a group consisting of polyolefins and polystyrenes, the syndiotactic polymer having Mw/Mn of no more than 4, Mw representing weight average molecular weight, Mn representing number average molecular weight.

Preferably, the syndiotactic polymer may be syndiotactic polystyrene obtained by polymerization using a metallocene catalyst. The syndiotactic polystyrene may preferably have Mw/Mn of no more than 3.

In a preferred embodiment, the resin composition comprises 15–30 parts by weight of glass fibers based on 100 parts by weight of the syndiotactic polystyrene.

Alternatively, the syndiotactic polymer may be syndiotactic polypropylene obtained by polymerization using a metallocene catalyst. Again, the syndiotactic polypropylene may preferably have Mw/Mn of no more than 3.

In another preferred embodiment, the resin composition comprises 15–30 parts by weight of mica based on 100 parts by weight of the syndiotactic polypropylene.

The loudspeaker component described above may be a diaphragm, voice coil bobbin, center cap, frame or cabinet of a loudspeaker.

According to a second aspect of the present invention, there is provided a loudspeaker component containing, as a main constituent, a syndiotactic polymer selected from a group consisting of polyolefins and polystyrenes, the syndiotactic a polymer having Mw/Mn of no more than 4, Mw representing weight average molecular weight, Mn representing number average molecular weight.

Other objects, features and advantages of the present invention will become apparent from the following detailed description given with reference to the accompanying drawings.

DETAILED DESCRIPTION OF THE PREFERRED EMBODIMENTS

Figure 1:
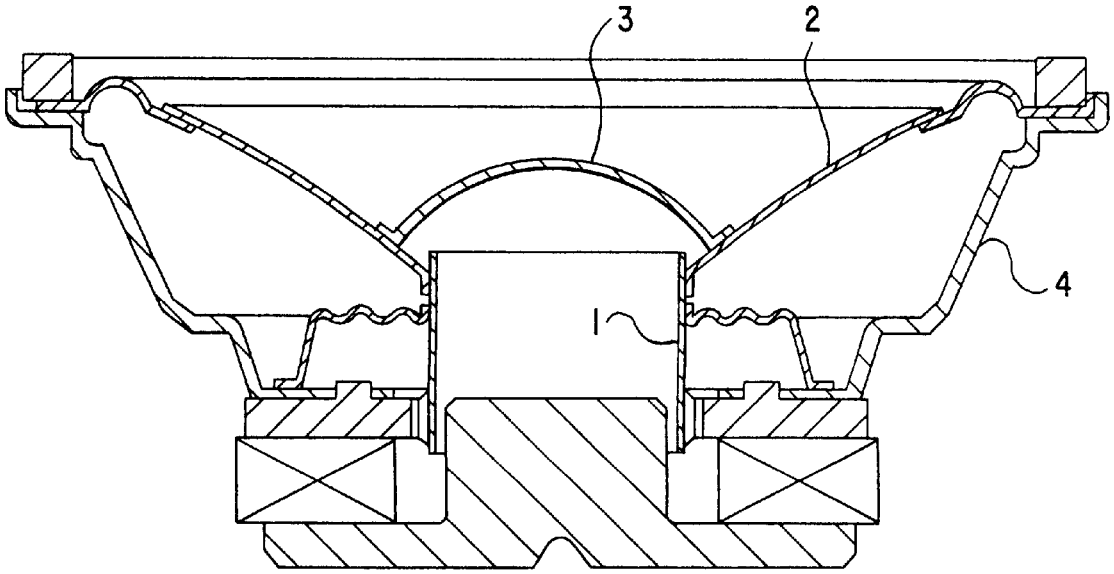
FIG.1 PRIOR ART
FIG. 1 is a schematic cross-sectional view illustrating the structure of a typical loudspeaker.

As previously described, a loudspeaker component according to the present invention is made of a resin composition which contains, as a main constituent, a syndiotactic polymer selected from a group consisting of polyolefins and polystyrenes. The syndiotactic polymer has an Mw/Mn value of no more than 4, where Mw represents weight average molecular weight, and Mn represents number average molecular weight.

By the term "main constituent" is meant that the polymer content in the resin composition is no less than 50 wt %.

Accordingly, the "resin composition" may contain the recited syndiotactic polymer alone.

The "syndiotactic polymer" is a polymer which has a syndiotactic structure. The "syndiotactic structure" is a structure wherein the substituents (e.g., the phenyl groups in the case of polystyrene) of the polymer are located alternately on the opposite sides of the main C—C chain of the polymer. Preferably, the syndiotactic polymer used in the present invention has a tacticity of no less than 30% as determined by $^{13}$C-NMR.

Typical examples of syndiotactic polyolefins include polypropylene, polyisobutylene, and polyamylene. Of these candidates, polypropylene is preferred because it has a wide utility and the resultant loudspeaker component has excellent properties (e.g., light weight and suitable internal loss).

Typical examples of syndiotactic polystyrenes include polystyrene (having no substituent), polymethylstyrene, and polyethylstyrene. Of these candidates, polystyrene is preferred because it has a wide utility and the resultant loudspeaker component has excellent properties (e.g., light weight).

The syndiotactic polymer used in the present invention has an Mw/Mn value of no more than 4, preferably no more than 3, particularly in the range of 2–2.5. Inevitably, the lower limit of the Mw/Mn value is unity (1). When the Mw/Mn value exceeds 4, insufficiency will often result with respect to flowability of the polymer as required for molding into a predetermined shape. Further, the resultant loudspeaker component may often be unsatisfactory with respect to various properties such as stiffness, heat resistance, chemical resistance and so on.

The degree of polymerization of the syndiotactic polymer may be in the range of 10–100000, preferably 100–10000, particularly 500–5000. The syndiotactic polymer having such a degree of polymerization provides an excellent degree of flowability for molding into a loudspeaker component while imparting a high dimensional stability of the resulting product.

The syndiotactic polymer may be prepared by any suitable polymerization process. Preferably, the polymerization may be performed with the use of a metallocene catalyst. Due to the use of a metallocene catalyst, the resulting polymer will have a high tacticity, and therefore the loudspeaker component will be excellent with respect to stiffness and internal loss.

The metallocene catalyst is represented by the following formula:

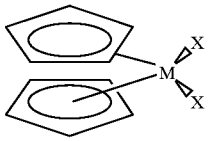

where M is a transition metal of group IV, preferably zirconium or titanium, particularly zirconium (in this case, the compound is referred to as zirconocene); and each of X is halogen, preferably bromine or chlorine. More preferably, the metallocene catalyst may contain methylaluminoxane represented by the following formula as a promoter:

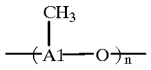

where n is an integer of 5–20. A metallocene catalyst containing zirconocene as a main constituent (e.g., in an amount of 80 wt %) and methylaluminoxane as a promoter (e.g., in an amount of about 20 wt %) is especially preferred for synthesizing the syndiotactic polymer used in the present invention.

The resin composition used in the present invention may contain any suitable additives such as a reinforcing material besides the syndiotactic polymer. In the case of polystyrene, the resin composition may preferably contain 15 to 30 parts by weight of glass fibers based on 100 parts by weight of the polymer. In the case of a polyolefin, the resin composition may preferably contain 15 to 30 parts by weight of mica (particularly mica scales) based on 100 parts by weight of the polymer. Such a combination of the polymer and the reinforcing material provides characteristics improvement of a loudspeaker component with respect to stiffness, elasticity, heat shrinkage and linear expansion.

FIG. 1 is a schematic cross-sectional view illustrating the structure of a typical loudspeaker. The present invention is applicable to, for example, a voice coil bobbin 1, a diaphragm 2, a center cap 3 or a frame 4 of the loudspeaker. Alternatively, the present invention is also applicable to a speaker cabinet (not shown).

The loudspeaker component made of the above-described resin composition according to the present invention may be fabricated by using any suitable shaping method. For example, the voice coil bobbin 1 may be formed by extrusion, whereas the diaphragm 2 may be formed by injection molding or pressing. The conditions for the shaping process may be optionally selected depending upon the requirements for the product.

Next, the technical advantages of the present invention will be described.

As previously described, the loudspeaker component according to the present invention is made of a resin composition containing a syndiotactic polyolefin (either substituted or non-substituted) or a syndiotactic polystyrene either substituted or non-substituted) having an Mw/Mn value of no more than 4 which is a very low level. A low Mw/Mn value means that molecules of the polymer lie in a narrow molecular weight range, so that the polymer molecules which are similar in molecular size are considered to be regularly arranged. Such regularity improves the flowability of the syndiotactic polymer, which is advantageous for providing good moldability or formability. Further, though the syndiotactic polymer become highly crystalline upon solidification after shaping, the original regularity of the polymer molecules suppresses a volumetric shrinkage caused by crystallization at the time of shaping. Moreover, the highly crystalline structure of the resultant loudspeaker component (i.e., the solidified polymer) provides high elasticity and stiffness (i.e., excellent acoustic properties) while also improving dimensional stability against heat and moisture. These are the unexpected advantages obtainable by the present invention. By contrast, the Mw/Mn value of a conventional polymer for a loudspeaker is no less than 6. It has been experimentally confirmed that a loudspeaker component made of such a polymer is much inferior to the loudspeaker component of the present invention with respect to elasticity, stiffness, moldability, and dimensional stability, as demonstrated hereinafter.

According to the preferred embodiment, the syndiotactic polymer is prepared by polymerization using a metallocene catalyst. The use of the metallocene catalyst provides a syndiotactic polymer having a very high tacticity, thereby additionally improving the properties of the loudspeaker component with respect to elasticity, stiffness, moldability, and dimensional stability. Besides, it has been also confirmed that the loudspeaker component made of such a polymer is satisfactory with respect to chemical resistance and electrical properties.

As previously described, the resin composition may further contain an appropriate amount of a reinforcing material. Specifically, a syndiotactic polystyrene may be combined with glass fibers, whereas a syndiotactic polyolefin may be combined with mica. Although theoretically clear as to the reasoning for the specific combination, the addition of the reinforcing material further improves the properties of the loudspeaker component with respect to stiffness, elasticity, heat shrinkage and linear expansion.

Next, specific examples of the present invention will be described together with comparative examples (hereafter referred to simply as "comparison"). However, the present invention is not limited to these specific examples. Further, unless otherwise stated, all proportions (either parts and percents) in the examples are based on weight.

EXAMPLE 1

A resin composition (XAREC®; pellets available from Idemitsu Petrochemical Co., Ltd., Japan) containing 100 parts of syndiotactic polystyrene (SPS as prepared by polymerization with the use of a metallocene catalyst) and 15 parts of glass fibers was extruded into a film having thickness of 50 $\mu$m. The extrusion was performed under the following conditions:

Cylinder Temperature: 270–290 (° C.)

Die Temperature: 140–150 (° C.)

Cooling Time: 90 (sec)

Extrusion Pressure: 500–1200 (kgf/cm$^2$)

Then, the thus obtained film was formed into a voice coil bobbin by a conventional method. Then, the voice coil bobbin was measured for its density ρ, Young's modulus (elastic modulus) E, water absorption rate, coefficient of linear expansion, and flowability (melt flow rate as determined for the resin composition) each by a conventional method. The results of measurement are shown in Table 1 below together with those for Example 2 and Comparisons 1–2 to be described later.

TABLE 1

| | I | II | III | IV | V |
|---|---|---|---|---|---|
| Example 1 | 1.11 | 4.59 | 0.05 | 3.9 | 11 |
| Example 2 | 1.25 | 7.67 | 0.05 | 2.5 | 6 |
| Comparison 1 | 1.57 | 2.94 | 2.0 | 4.5 | — |
| Comparison 2 | 1.64 | 3.92 | 0.05 | 4.0 | — |

I: Density ρ (g/cm$^3$)
II: Young's Modulus E ($10^{10}$ dyn/cm$^2$)
III: Water Absorption Rate (%)
IV: Coefficient of Linear Expansion ($10^{-5}$/° C.)
V: Flowability (g/10 min)

EXAMPLE 2

A voice coil bobbin was formed in the same manner as in Example 1 except that the glass fiber content was increased to 30 parts. Then, the thus obtained voice coil bobbin was evaluated for its properties in the same manner as in Example 1. The results are shown in Table 1 above.

Comparison 1

A voice coil bobbin was formed using polyimide (PI). The thus obtained voice coil bobbin was evaluated for its properties in the same manner as in Example 1. The results are shown in Table 1 above.

Comparison 2

A voice coil bobbin was formed using polyphenylene sulfide (PPS). The thus obtained voice coil bobbin was evaluated for its properties in the same manner as in Example 1. The results are shown in Table 1 above.

As is apparent from Table 1, the voice coil bobbin in each a of Examples 1 and 2 had a lower density and a higher elastic modulus than those in Comparisons 1 and 2. Further, the voice coil bobbin in each of these examples had a smaller water absorption rate and a lower coefficient of linear expansion. Accordingly, it is understood that the voice coil bobbin of the present invention had excellent acoustic properties while providing a high dimensional stability against moisture. In addition, the resin composition used for making the voice coil bobbin of the present invention was also practically satisfactory in melt flow rate despite the inclusion of glass fibers, hence satisfactory moldability. For the reference, a resin composition without glass fibers had a melt flow rate of 13 g/10 min.

EXAMPLE 3

A film having a thickness of 50 $\mu$m was prepared in the same manner as in Example 1 except that the resin composition did not contain glass fibers. Then, the thus obtained film was pressed under 150 to 170° C. into a dome-shaped diaphragm having a diameter of 25 mm.

Then, the diaphragm was measured for its density ρ, Young's modulus (elastic modulus) E, E/ρ, and internal loss each by a conventional method. The results of measurement are shown in Table 2 below together with those of Comparative Examples 3 and 4 to be described later.

Figure 2A:
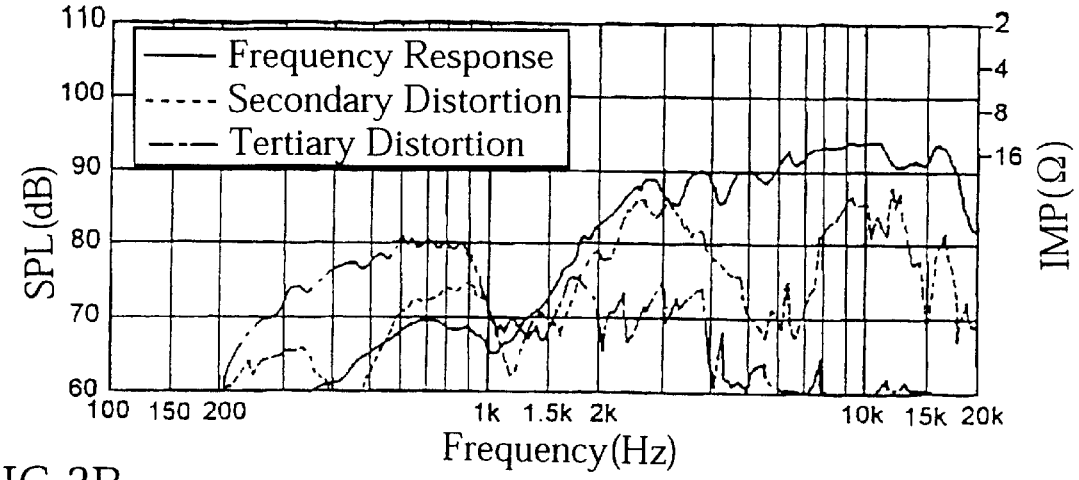
FIG. 2A is a graph illustrating the sound pressure-frequency characteristics of a diaphragm embodying the present invention.

On the other hand, the diaphragm was also measured for its sound pressure-frequency characteristics (frequency, impedance, secondary distortion and tertiary distortion). The measurement was performed at 50 cm above the diaphragm on the normal axis thereof when the output of the speaker was 1 W. The results are shown in FIG. 2A.

TABLE 2

| | I | II | VI | VII |
|---|---|---|---|---|
| Example 3 | 1.04 | 2.55 | 2.45 | 0.031 |
| Comparison 3 | 1.28 | 1.82 | 1.42 | 0.026 |
| Comparison 4 | 1.53 | 2.12 | 1.39 | 0.022 |

I: Density ρ (g/cm$^3$)
II: Young's Modulus E ($10^{10}$ dyn/cm$^2$)
VI: E/ρ
VII: Internal Loss (tan δ)

Comparison 3

Figure 2B:
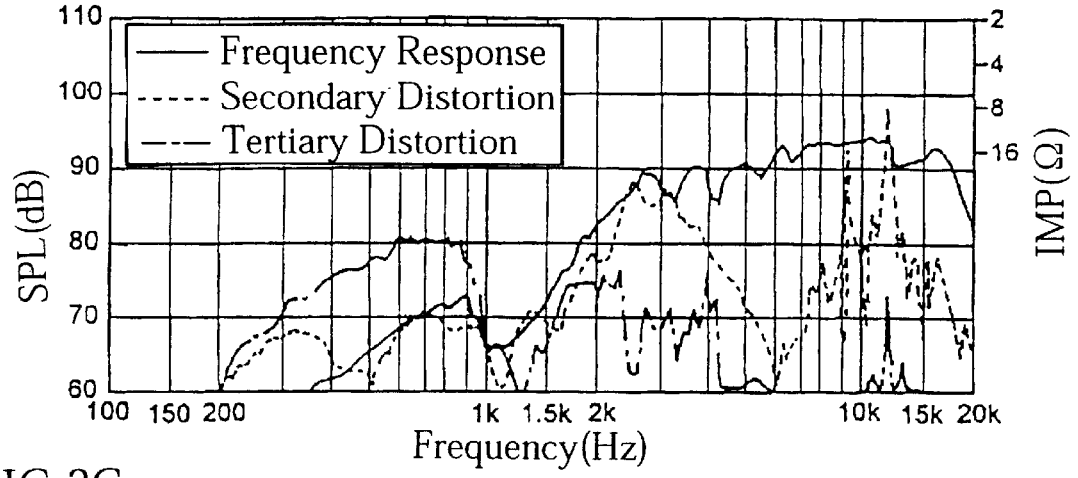
FIG. 2B is a graph illustrating the sound pressure-frequency characteristics of a polyimide diaphragm in accordance with the prior art for comparison.

A dome-shaped diaphragm having a diameter of 25 mm was obtained using polyetherimide (PEI). The thus obtained diaphragm was measured for its properties in the same manner as in Example 3. The results are shown in Table 2 and FIG. 2B, respectively.

Comparison 4

Figure 2C:
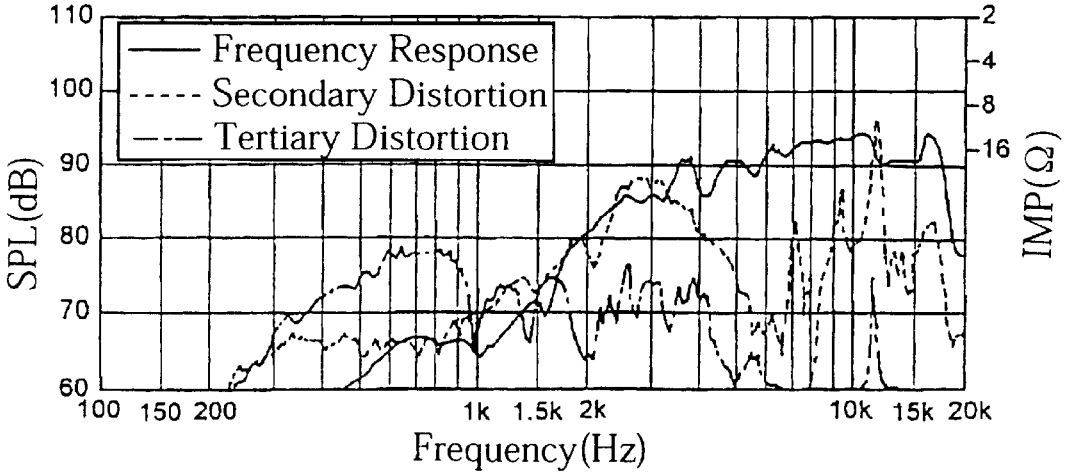
FIG. 2C is a graph illustrating the sound pressure-frequency characteristics of a polyphenylene sulfide diaphragm in accordance with the prior art for comparison.

A dome-shaped diaphragm having a diameter of 25 mm was obtained using polyetheretherketone (PEEK). The thus obtained diaphragm was measured for its properties in the same manner as in Example 3. The results are shown in Table 2 and FIG. 2C, respectively.

As is apparent from Table 2, the density of the diaphragm in Example 3 was smaller by about 18% than that in Comparison 3 and by about 32% than that in Comparison 4. Further, the Young's modulus and internal loss of the diaphragm in Example 3 were improved by about 20–40% compared to those in Comparisons 3 and 4. The specific modulus of elasticity of the diaphragm in Example 3 was also improved by about 75% compared to those of Comparisons 3 and 4. Furthermore, it was confirmed through visual observation that the diaphragm in Example 3 suffered smaller shrinkage (i.e., higher dimensional stability) than those in Comparisons 3 and 4. Thus, as is apparent from comparison of FIG. 2A with FIGS. 2B and 2C, the sound pressure-frequency characteristics of the diaphragm in Example 3 exhibited a reduced harmonic distortion in a middle-to-high frequency region while also exhibiting a shift of the upper threshold frequency to a higher frequency region. In other words, a wider frequency band and clear acoustic sound are obtained according to the present invention.

EXAMPLE 4

A resin composition containing 100 parts of syndiotactic polypropylene (SPP as prepared by polymerization using a metallocene catalyst) and 30 parts of mica scales was subjected to an injection molding to obtain a cone-shaped diaphragm having a diameter of 16 cm. The injection molding were performed under the following conditions:

Cylinder Temperature: 230–250 (° C.)

Nozzle Temperature: 250 (° C.)

Mold Temperature: 50 (° C.)

Cooling Time: 90 (sec)

Injection Pressure: 500–1200 (kgf/cm$^2$)

Back Pressure: 5–10 (kgf/cm$^2$)

Injection Speed: 40–70 (%)

Screw Rotation: 50–100 (rpm)

Figure 3A:
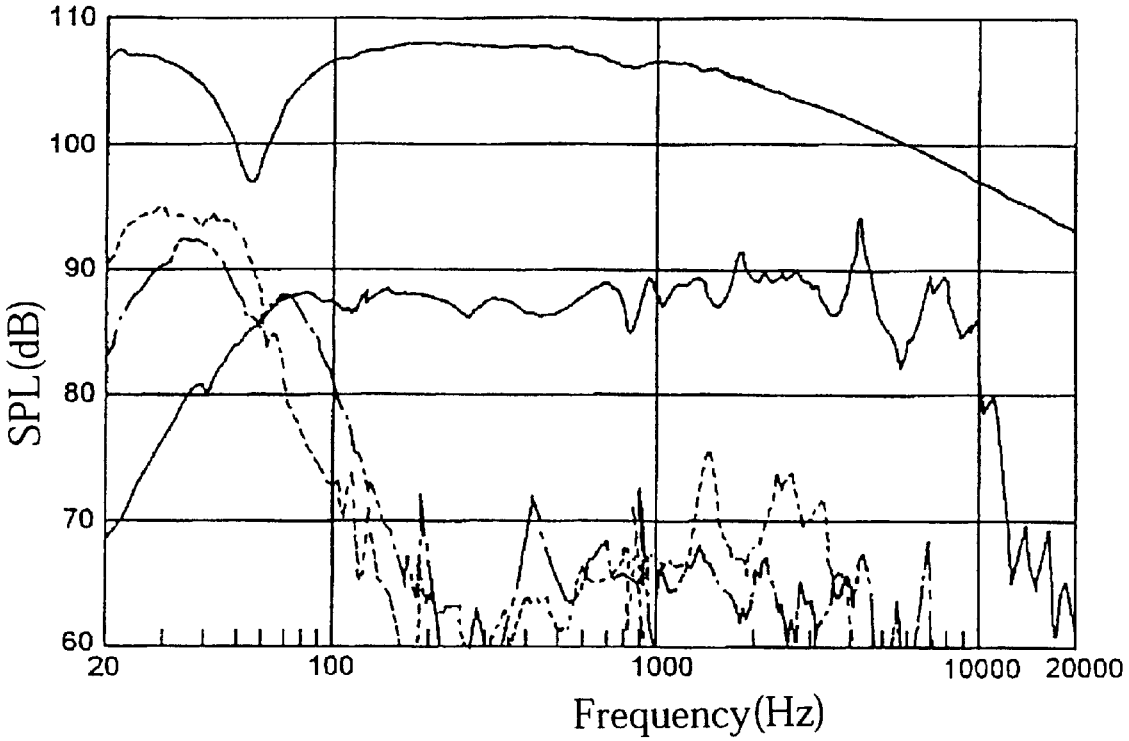
FIG. 3A is a graph illustrating the sound pressure-frequency characteristics of another diaphragm embodying the present invention.

The thus obtained diaphragm was measured for its density ρ, Young's modulus (elastic modulus) E, internal loss and molding-shrinkage each by a conventional method. The results of measurement are shown in Table 3 below together with those for Comparison 5 to described later. Further, the diaphragm was also measured for its sound pressure-frequency characteristics (frequency, impedance, secondary distortion and tertiary distortion). The measurement was performed at 50 cm above the diaphragm on the normal axis thereof when the output was 1 W. The results are shown in FIG. 3A.

TABLE 3

| | I | II | VII | VIII |
|---|---|---|---|---|
| Example 4 | 1.01 | 4.29 | 0.040 | 0.35 |
| Comparison 5 | 1.13 | 3.88 | 0.041 | 1.90 |

I: Density ρ (g/cm$^3$)
II: Young's Modulus E ($10^{10}$ dyn/cm$^2$)
VII: Internal Loss (tan δ)
VIII: Molding Shrinkage (%)

Comparative Example 5

Figure 3B:
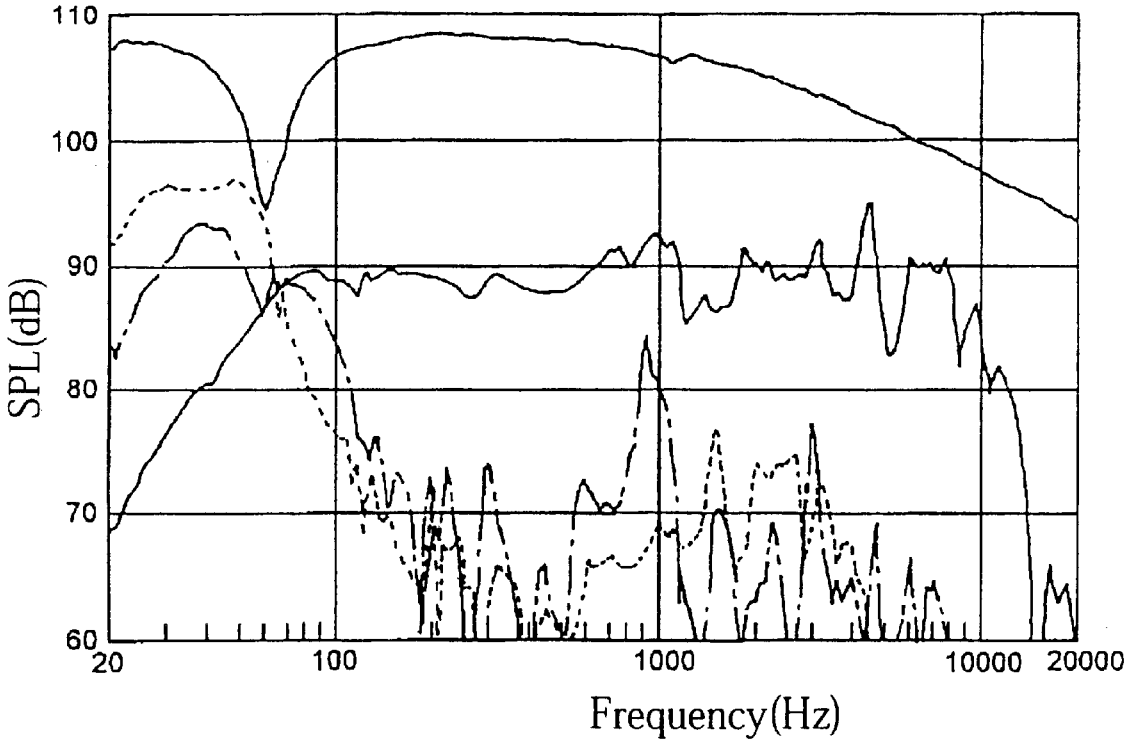
FIG. 3B is a graph illustrating the sound pressure-frequency characteristics of an isotactic polypropylene diaphragm for comparison.

A resin composition containing 100 parts of isotactic polypropylene (IPP as prepared by polymerization using a Ziegler-Natta catalyst) and 30 parts of mica scales was subjected to an injection molding to form a cone-shaped diaphragm having a diameter of 16 cm. The thus obtained diaphragm was measured for its properties in the same manner as in Example 4. The results are shown in Table 3 and FIG. 3B, respectively.

As is apparent from Table 3, the diaphragm in Example 4 had a lower density (i.e., lighter weight) and a higher elastic modulus than that in Comparison 5. Further, the dimensional stability of the diaphragm in Example 4 was remarkably higher (i.e., lower molding shrinkage) than in Comparison 5. In addition, as is apparent from the comparison between FIGS. 3A and 3B, the sound pressure-frequency characteristics of the diaphragm in Example 4 exhibited a reduced harmonic distortion in a middle-to-high frequency region. Thus, clear acoustic sound without a so-called "buzz" is obtainable even at high-power input.

Various other modifications will be apparent to and can be readily made by those skilled in the art without departing from the scope and spirit of the present invention. Accordingly, it is not intended that the scope of the claims appended hereto be limited to the description as set forth herein, but rather that the claims be broadly construed.

What is claimed is:

1. A loudspeaker component made of a resin composition comprising, as a main constituent, a syndiotactic polymer selected from a group consisting of polyolefins and polystyrenes, the syndiotactic polymer having Mw/Mn of no more than 4, Mw representing weight average molecular weight, Mn representing number average molecular weight.

2. The loudspeaker component according to claim 1, wherein the syndiotactic polymer has Mw/Mn of no more than 3.

3. The loudspeaker component according to claim 1, wherein the syndiotactic polymer is syndiotactic polystyrene obtained by polymerization using a metallocene catalyst.

4. The loudspeaker component according to claim 3, wherein the syndiotactic polystyrene has Mw/Mn of no more than 3.

5. The loudspeaker component according to claim 3, wherein the metallocene catalyst comprises a combination of zirconocene and methylaluminoxane.

6. The loudspeaker component according to claim 3, wherein the resin composition comprises 15–30 parts by weight of glass fibers based on 100 parts by weight of the syndiotactic polystyrene.

7. The loudspeaker component according to claim 1, wherein the syndiotactic polymer is syndiotactic polypropylene obtained by polymerization using a metallocene catalyst.

8. The loudspeaker component according to claim 7, wherein the syndiotactic polypropylene has Mw/Mn of no more than 3.

9. The loudspeaker component according to claim 7, wherein the metallocene catalyst comprises zirconocene and methylaluminoxane.

10. The loudspeaker component according to claim 7, wherein the resin composition comprises 15–30 parts by weight of mica based on 100 parts by weight of the syndiotactic polypropylene.

11. The loudspeaker component according to claim 1, which is a diaphragm of a loudspeaker.

12. The loudspeaker component according to claim 1, which is a voice coil bobbin of a loudspeaker.

13. The loudspeaker component according to claim 1, which is a center cap of a loudspeaker.

14. The loudspeaker component according to claim 1, which is a frame of a loudspeaker.

15. The loudspeaker component according to claim 1, which is a cabinet of a loudspeaker.

16. A resin composition for a loudspeaker component containing, as a main constituent, a syndiotactic polymer selected from a group consisting of polyolefins and polystyrenes, the syndiotactic polymer having Mw/Mn of no more than 4, Mw representing weight average molecular weight, Mn representing number average molecular weight.

17. The resin composition according to claim 16, wherein the syndiotactic polymer is syndiotactic polystyrene having Mw/Mn of no more than 3.

18. The resin composition according to claim 17, which contains 15–30 parts by weight of glass fibers based on 100 parts by weight of the syndiotactic polystyrene.

19. The resin composition according to claim 16, wherein the syndiotactic polymer is syndiotactic polypropylene having Mw/Mn of no more than 3.

20. The resin composition according to claim 19, which contains 15–30 parts by weight of mica based on 100 parts by weight of the syndiotactic polypropylene.

* * * * *